US011571103B2

(12) United States Patent
Zhang et al.

(10) Patent No.: US 11,571,103 B2
(45) Date of Patent: Feb. 7, 2023

(54) TURNTABLE STRUCTURE, MOPPING DEVICE AND ROBOT

(71) Applicant: Yunjing Intelligence Technology (Dongguan) Co., Ltd., Dongguan (CN)

(72) Inventors: Junbin Zhang, Dongguan (CN); Jibiao Huang, Dongguan (CN); Weijin Lin, Dongguan (CN)

(73) Assignee: Yunjing Intelligence Technology (Dongguan) Co., Ltd., Dongguan (CN)

( * ) Notice: Subject to any disclaimer, the term of this patent is extended or adjusted under 35 U.S.C. 154(b) by 0 days.

(21) Appl. No.: 17/674,221

(22) Filed: Feb. 17, 2022

(65) Prior Publication Data

US 2022/0167818 A1 Jun. 2, 2022

Related U.S. Application Data

(63) Continuation of application No. 17/199,699, filed on Mar. 12, 2021, which is a continuation of application No. PCT/CN2019/104297, filed on Sep. 4, 2019.

(30) Foreign Application Priority Data

Sep. 14, 2018 (CN) ..... 201811079151.5

(51) Int. Cl.

| | |
|---|---|
| ***A47L 11/284*** | (2006.01) |
| ***A47L 11/283*** | (2006.01) |
| ***A47L 11/40*** | (2006.01) |

(52) U.S. Cl.

CPC ..... *A47L 11/284* (2013.01); *A47L 11/283* (2013.01); *A47L 11/4061* (2013.01); *A47L 2201/00* (2013.01)

(58) Field of Classification Search

CPC .. A47L 11/284; A47L 11/283; A47L 11/4061; A47L 2201/00

See application file for complete search history.

(56) References Cited

U.S. PATENT DOCUMENTS 6,425,169 B1 * 7/2002 Briscoe ..... A47L 11/4058 403/138
2018/0003265 A1 * 1/2018 Jung ..... F16H 57/0498
(Continued)

FOREIGN PATENT DOCUMENTS

CN 106667382 A * 5/2017
CN 106955063 A 7/2017
(Continued)

OTHER PUBLICATIONS

Examination Report No. 1 issued in counterpart Australian Patent Application No. 2019339975, dated Apr. 29, 2022.
(Continued)

*Primary Examiner* — Marc Carlson
(74) *Attorney, Agent, or Firm* — Westbridge IP LLC

(57) ABSTRACT

A turntable structure includes a cleaning turntable having one side connected with a cleaning piece; an adjusting component slidably connected with the cleaning turntable along a target direction, and located on another side of the cleaning turntable opposite to the cleaning piece, the adjusting component having a side far away from the cleaning turntable and connected with a driving mechanism of a robot to rotate the cleaning turntable, the target direction being parallel to a rotating shaft of the cleaning turntable; a pressure unit provided between the cleaning turntable and the adjusting component and for pressing against the cleaning turntable; and a first limiting structure configured to limit a sliding distance of the cleaning turntable relative to the adjusting component along the target direction.

8 Claims, 12 Drawing Sheets

(56) References Cited

U.S. PATENT DOCUMENTS

| | | | | |
|---|---|---|---|---|
| 2019/0328193 | A1* | 10/2019 | Yang | A47L 7/0009 |
| 2021/0100420 | A1* | 4/2021 | Yan | A46B 5/0041 |

FOREIGN PATENT DOCUMENTS

| | | | | | |
|---|---|---|---|---|---|
| CN | 107049159 | A | * | 8/2017 | A47L 11/283 |
| CN | 108814461 | A | * | 11/2018 | A47L 11/00 |
| DE | 10016404 | A1 | | 10/2001 | |
| EP | 2756787 | A1 | | 7/2014 | |
| JP | S63200731 | A | | 8/1988 | |
| JP | H0336491 | A | | 2/1991 | |
| JP | 2001517990 | A | | 10/2001 | |
| WO | 2018086090 | A1 | | 5/2018 | |

OTHER PUBLICATIONS

Notice of Reasons for Refusal issued in counterpart Japanese Patent Application No. 2021-513974, dated May 24, 2022.
Notification of Reason for Refusal issued in counterpart Korean Patent Application No. 10-2021-7010708, dated Apr. 19, 2022.
Supplementary European Search Report issued in counterpart European Patent Application No. 19860590.9, dated Jun. 10, 2022.

* cited by examiner

TURNTABLE STRUCTURE, MOPPING DEVICE AND ROBOT

CROSS-REFERENCE TO RELATED APPLICATIONS

The present application is a continuation application of U.S. patent application Ser. No. 17/199,699, filed on Mar. 12, 2021, which is a continuation application of International Application No. PCT/CN2019/104297, filed on Sep. 4, 2019, which claims the priority of Chinese patent application No. 201811079151.5, filed on Sep. 14, 2018 in the Chinese Patent Office and titled "Turntable Structure, Mopping Device and Robot", the entire contents of which are incorporated herein by reference.

FIELD

The present application relates to the field of robots, particularly to a turntable structure, a mopping device and a robot.

BACKGROUND

With the development of the science technology, cleaning robots are widely used in production and life. According to different usages, the cleaning robots can be divided into sweeping robots and mopping robots. The cleaning robots can meet users' demands for cleaning the floor. The cleaning robots achieve the cleaning operations on the floors by the cleaning components. However, on a uneven floor, the cleaning components of the cleaning robots cannot fit the floor, thereby the cleaning effect on the floor is poor.

The above content is only provided to assist the understanding of the technical solutions of this application, and does not mean that the above content is recognized as prior art.

SUMMARY

The application provides a turntable structure and robot, which are configured to improve the cleaning effect on the floor.

An embodiment of the present application provides a turntable structure, including a cleaning turntable, one side of the cleaning turntable being connected with a cleaning piece configured to clean a floor; an adjusting component, the adjusting component slidably connected with the cleaning turntable along a target direction, and located on a side of the cleaning turntable facing away from the cleaning piece, the target direction being parallel to a rotating shaft of the cleaning turntable, and one side of the adjusting component far away from the cleaning piece being connected with a driving mechanism of a robot to drive the cleaning turntable to rotate; and a pressure unit being provided between the cleaning turntable and the adjusting component, and configured to apply a vertical downward force to the cleaning turntable when the target direction is perpendicular to a horizontal plane.

The present application also provides a mopping device, including a cleaning turntable; an adjusting component relatively slidably connected with the cleaning turntable in a direction parallel to the axis of the cleaning turntable, the cleaning turntable being located at a first position when sliding to the furthest distance relative to the adjusting component, the cleaning turntable being located at a second position when sliding to the closest distance relative to the adjusting component; a driving mechanism connected with the adjusting component and driving the adjusting component and the cleaning turntable to rotate; and a pressure unit provided between the cleaning turntable and the adjusting component and pushing against the cleaning turntable; the cleaning turntable being located at the first position relative to the adjusting component when the cleaning turntable is not subject to external force; the cleaning turntable being located at the second position relative to the adjusting component when the cleaning turntable is subject to external force much greater than the pressure of the pressure unit, and when the external force applied to the cleaning turntable is less than the pressure of the pressure unit, the pressure unit driving the cleaning turntable to move from the second position to the first position relative to the adjusting component until the cleaning turntable is subject to a balance force, and the cleaning turntable being located at a third position relative to the adjusting component, and the third position being located between the first and second positions.

The present application also provides a robot, the robot includes a robot body, a mopping module provided at a bottom of the robot body and comprising a turntable structure and a cleaning piece; and a driving mechanism installed on the robot body, connected with an adjusting component and configured to rotate the mopping module; wherein the turntable structure includes a cleaning turntable, one side of the cleaning turntable being connected with the cleaning piece configured to clean a floor; the adjusting component slidably connected with the cleaning turntable along a target direction, and located on one side of the cleaning turntable facing away from the cleaning piece, the target direction being parallel to a rotating shaft of the cleaning turntable, one side of the adjusting component far away from the cleaning piece being connected with the driving mechanism of the robot to drive the cleaning turntable to rotate; and a pressure unit provided between the cleaning turntable and the adjusting component, and configured to apply a vertical downward force to the cleaning turntable when the target direction is perpendicular to a horizontal plane.

In the turntable structure and robot of the present application, one side of the cleaning turntable is connected with the cleaning piece, and the adjusting component slidably is connected with another side of the cleaning turntable along the target direction, thereby the cleaning turntable can slide relative to the adjusting component. When the target direction is perpendicular to the horizontal plane, the pressure unit is configured to apply a vertical downward force to the cleaning turntable, and since the cleaning turntable can slide relative to the adjusting component along the target direction, thereby the cleaning piece configured to clean the floor can keep fit the floor to improve the cleaning effect on the floor.

BRIEF DESCRIPTION OF THE DRAWINGS

In order to more clearly describe the technical solutions in the embodiments of the present application or the related art, the drawings required to be used in the description of the embodiments or the related art will be briefly introduced as below. Obviously, the drawings described as below are only some embodiments of the application. For those of ordinary skill in the art, other drawings can be obtained according to the structures shown in those drawings without creative work.

DETAILED DESCRIPTION OF THE EMBODIMENTS

Figure 1:
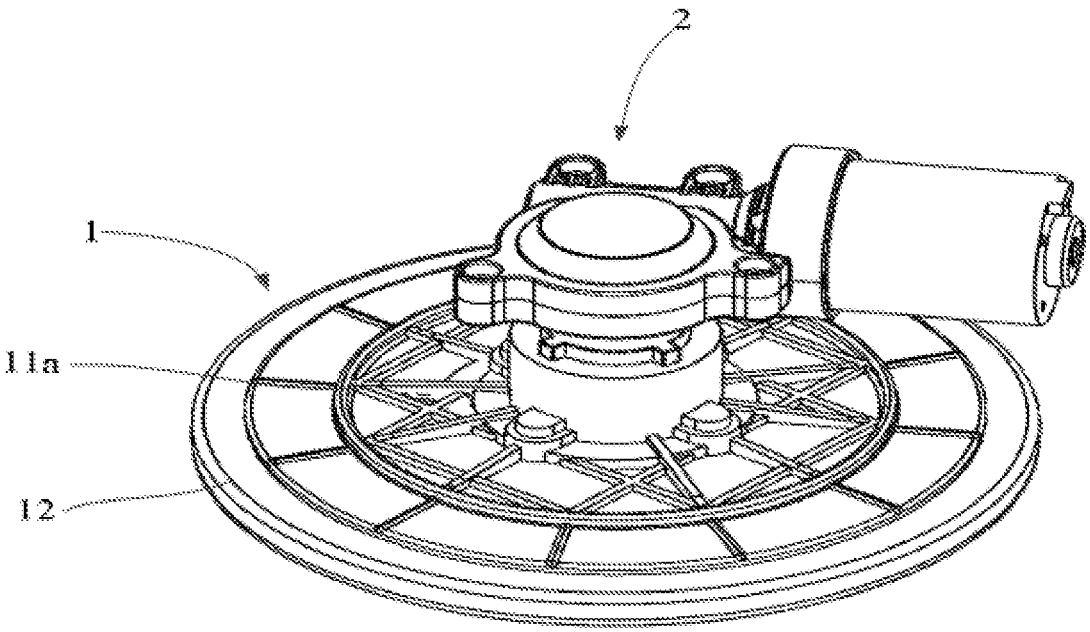
FIG. 1 is a perspective schematic view of a mopping module and a driving mechanism provided by an embodiment of the present application.

The technical solutions in the embodiments of the present application will be clearly and completely described as below in combination with the drawings in the embodiments of the present application. Obviously, the described embodiments are only a part rather than all of the embodiments of the present application. Based on the embodiments in the present application, all other embodiments obtained by those of ordinary skill in the art without creative work shall fall within the protection scope of the present application.

It should be noted that if there are directional indications (such as up, down, left, right, front, back . . . ) involved in the embodiments of the present application, the directional indications are only configured to explain the relative position relationship, movement situation, etc. among components in a specific posture (as shown in the drawings), and if the specific posture changes, the directional indication will change accordingly.

In addition, if there are descriptions related to "first", "second" etc. involved in the embodiments of the present application, the descriptions of "first", "second", etc. are only for descriptive purposes, and cannot be understood as instructing or implicating its relative importance or implicitly indicating a number of technical features indicated. Therefore, the features provided with "first" and "second" may explicitly or implicitly include at least one of the features. In addition, the meaning of "and/or" appearing in the context means including three parallel solutions, taking "A and/or B" as an example, "A and/or B" includes only solution A, or only solution B, or both solutions A and B. In addition, the technical solutions among the various embodiments can be combined with each other, but the combinations must be based on what can be achieved by those of ordinary skill in the art. When a combination of technical solutions is contradictory or cannot be achieved, it should be considered that such a combination of technical solutions does not exist and is not within the protection scope claimed by the present application.

The present application provides a turntable structure, which includes a cleaning turntable, an adjusting component and a pressure unit. One side of the cleaning turntable is connected with a cleaning piece which is configured to clean a floor. The adjusting component is slidably connected with a side of the cleaning turntable far away from the cleaning piece along a target direction, and the target direction is parallel to a rotating shaft of the cleaning turntable. The side of the adjusting component far away from the cleaning piece is configured to connect with a driving mechanism of a robot to drive the cleaning turntable to rotate. The pressure unit is provided between the cleaning turntable and the adjusting component and is configured to apply a vertical downward force to the cleaning turntable when the target direction is perpendicular to a horizontal plane.

Generally, there are two types of application scenarios when using a robot to clean a floor. One type is that the floor is mostly flat, and the other type is that the floor is uneven. In the former scenario, due to the floor is mostly flat, the cleaning component fits the floor well, thereby the robot has a better cleaning effect when moving on this kind of floor. However, in the latter scenario, due to the floor is uneven, the cleaning component can not fit the floor well, which will affect the cleaning effect of the cleaning piece, thereby the robot has a poor cleaning effect when moving on this kind of floor.

After using the turntable structure with telescoping function provided in the present application, even if moving on an uneven floor, with the sliding relationship between the adjusting component and the cleaning turntable, and the pressure unit adjusting a degree of the cleaning piece fitting the floor, the robot can adjust the cleaning piece to closely fit the floor, thereby ensuring the cleaning effect of the robot on the floor.

It should be noted that the above scenarios are only examples of scenarios where the embodiments of the present application can be applied to help those of skill in the art understand the technical contents of the present application, it does not mean that the embodiments of the present application cannot be configured to other devices, systems, environments or scenarios.

First Embodiment

Figure 2:
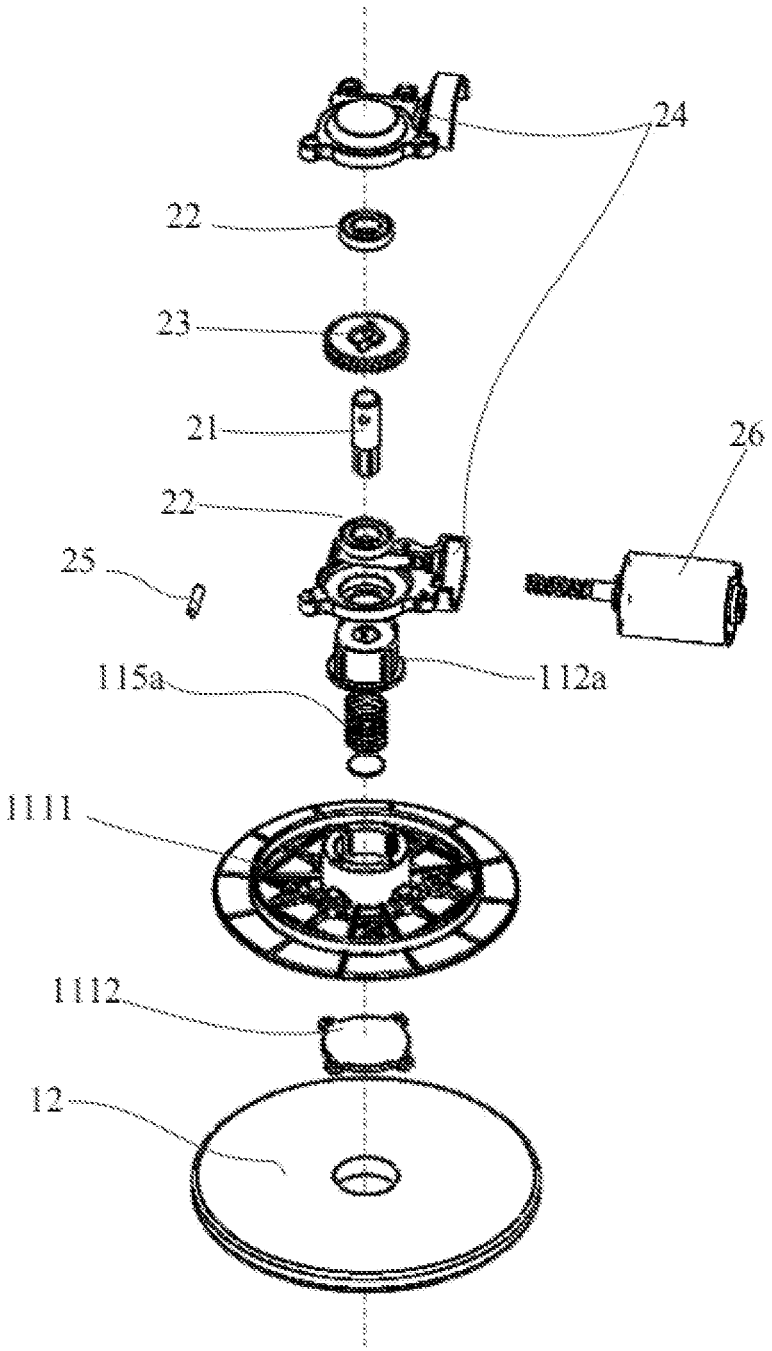
FIG. 2 is an exploded view of the mopping module and the driving mechanism as of FIG. 1.
Figure 3:
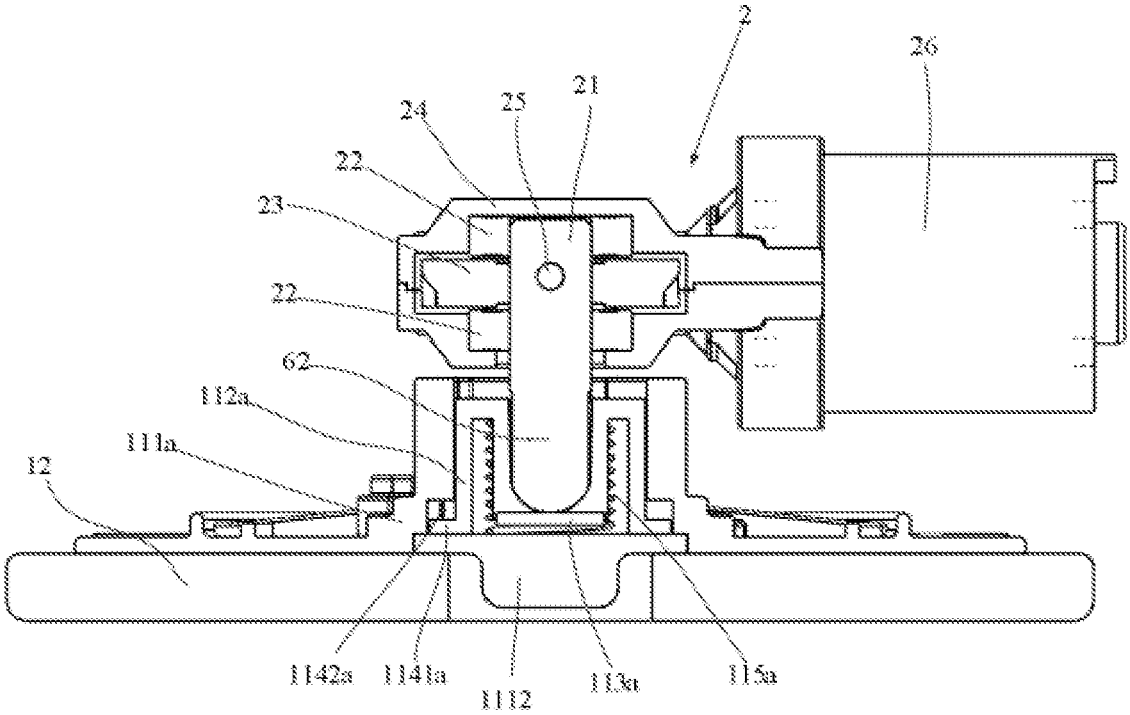
FIG. 3 is a cross-sectional view of the mopping module and the driving mechanism of FIG. 1.

The first embodiment of the present application provides a turntable structure. As shown in FIGS. 1 to 3, the turntable structure 11*a* includes: a cleaning turntable 111*a*, an adjusting component 112*a* and a pressure unit 115*a*. One side of the cleaning turntable 111*a* is connected with the cleaning piece 12 which is configured to clean a floor. The connection between the cleaning turntable 111*a* and the cleaning piece 12 may be a detachable connection or a non-detachable connection, such as glue bonding, bolt connected, or connected with velcro. The cleaning piece in the embodiment of the present application may be a mop, or bristles, etc., which is not specifically limited in the embodiment of the present application.

Figure 4:
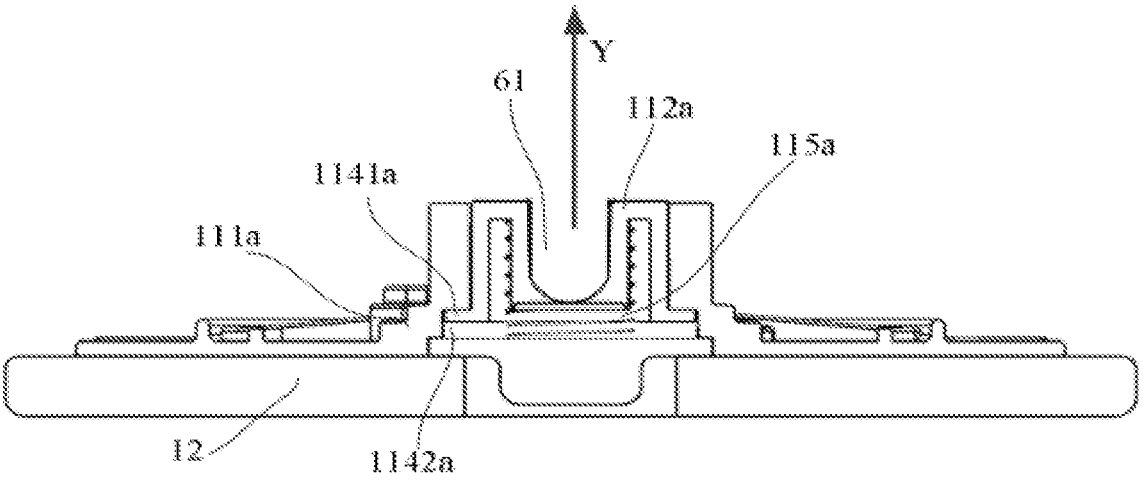
FIG. 4 is a cross-sectional view of the mopping module of FIG. 1.

The adjusting component 112*a* is slidably connected with one side of the cleaning turntable 111*a* far away from the cleaning piece along a target direction, that is, the adjusting component 112*a* is slidably connected with the cleaning turntable structure 111*a* along the target direction and the adjusting component 112*a* is located on a surface of the leaning turntable 111*a* facing away from the cleaning piece 12. The target direction is parallel to a rotating shaft of the cleaning turntable. For example, the target direction is indicated by Y direction and Y's opposite direction shown in FIG. 4. In such way, after the adjusting component 112*a* is connected with the cleaning turntable 111*a*, the adjusting component 112*a* can slide relative to the cleaning turntable 111*a* along Y direction or Y's opposite direction. The side of the adjusting component 112*a* far away the cleaning piece 12 is configured to connect with a driving structure 2 of the robot to drive the cleaning turntable 111*a* to rotate. Specifically, the connection between the adjusting component 112*a* and the driving mechanism are detachable connection, fixed connection or another connection. The driving mechanism 2 can transmit torque to the adjusting component 112*a* to drive the adjusting component 112*a* to rotate. The cleaning turntable 111*a* can rotate under drive of the adjusting component 112*a*, thereby the cleaning piece 12 connected with the cleaning turntable 111*a* rotates under drive of the cleaning turntable 111*a*.

The pressure unit 115*a* is provided between the cleaning turntable 111*a* and the adjusting component 112*a*, and the pressure unit 115*a* is configured to apply a vertical downward force to the cleaning turntable 111*a* when the target direction is perpendicular to the horizontal plane. The cleaning turntable 111*a* can slide relative to the adjusting component 112*a* along the target direction. The specific sliding direction of the cleaning turntable 111*a* is related to the force applied to the cleaning turntable 111*a*. For example, when the target direction is perpendicular to the horizontal plane, during the working process, when the force applied to the cleaning turntable 111*a* by the floor is greater than a sum of the gravity of the cleaning turntable 111*a* and the force applied to the cleaning turntable 111*a* by the pressure unit 115*a*, the cleaning turntable 111*a* slides upward relative to the adjusting component 112*a*; when the force applied to the cleaning turntable 111*a* by the floor is less than the sum of the gravity of the cleaning turntable 111*a* and the force applied to the cleaning turntable 111*a* by the pressure unit 115*a*, the cleaning turntable 111*a* slides downwards relative to the adjusting component 112*a*.

In an embodiment of the present application, the pressure unit 115*a* of the embodiment of the present application is an elastic element 115*a*, and the elastic element 115*a* elastically abuts against the cleaning turntable 111*a* and the adjusting component 112*a*, respectively. The elastic element 115*a* is specifically a spring. Two ends of the spring elastically abut against the cleaning turntable 111*a* and the adjusting component 112*a*, respectively.

When using a robot equipped with the turntable structure 11*a* of the first embodiment of the present application, in the advance direction of the robot, when the robot walks on a concave floor, at the time that the force applied to the cleaning turntable 111*a* by the floor is less than the sum of the gravity of the cleaning turntable 111*a* and the force applied to the cleaning turntable by the elastic element 115*a*, the cleaning turntable 111*a* slides downward relative to the adjusting component 112*a*. If the robot walks on a convex floor, and the force applied to the cleaning turntable 111*a* by the floor is greater than the sum of the gravity of the cleaning turntable 111*a* and the force applied to the cleaning turntable by the elastic element 115*a*, the cleaning turntable 111*a* slides upward relative to the adjusting component 112*a*.

It can be understood that "up" and "down" in the first embodiment of the present application can be understood as the up-down orientation in FIG. 3.

It can be understood that the cleaning turntable 111*a* of the embodiment of the present application is a rotatable structure. During the cleaning process, the cleaning turntable 111*a* may or may not rotate.

It can be understood that the floor of the embodiment of the present application may be a wooden floor, a tile floor, a cement floor, etc., which is not specifically limited in the embodiment of the present application.

It can be understood that the target direction of the embodiment of the present application may be perpendicular to the horizontal plane, or may have a certain inclination angle relative to the horizontal plane. When the target direction is inclined to the horizontal plane, the rotating shaft of the cleaning turntable 111*a* is inclined to the horizontal plane too. In some embodiments, when the target direction is inclined to the horizontal plane, the force applied to the cleaning turntable by the pressure unit 115*a* is vertically downward. In other words, the force applied to the cleaning turntable by the pressure unit 115*a* does not change with a change of an angle between the target direction and the horizontal plane, the force applied to the cleaning turntable by the pressure unit 115*a* is kept straight down. In other embodiments, when the target direction is inclined to the horizontal plane, the force applied by the pressure unit 115*a* to the cleaning turntable is inclined to the horizontal plane too. For example, the direction of the force applied to the cleaning turntable by the pressure unit 115*a* is parallel to the target direction.

In the embodiment of the present application, the rotating shaft is a geometric straight line around which the rotating body rotates. For example, the cleaning turntable 111*a* rotates around its rotating shaft.

According to the embodiment of the present application, because the turntable structure 11*a* with telescoping function is adopted, the technical problem of poor cleaning effect of the cleaning robot in the related art can be at least partially solved, and the purpose of the cleaning piece capable of keeping closely fitting the floor when being used can be achieved, thereby improving the cleaning effect of the robot. In addition, the solution of the embodiment of the present application also avoids the vibration of the robot caused by a unbalance of the mop of the cleaning component during the cleaning process.

FIGS. 1 to 5 are related schematic views of the turntable structure 11*a* provided in the first embodiment of the application. In the first embodiment, the cleaning turntable 111*a* includes a first turntable housing 1111 and a limiting plate 1112. The limiting plate 1112 is connected with a slotted end of the first turntable housing 1111, and a specific connection method may be a snap connection or a threaded connection, etc. The adjusting component 112*a* is accommodated in a cavity formed by the limiting plate 1112 and the first turntable housing 1111.

Figure 5:
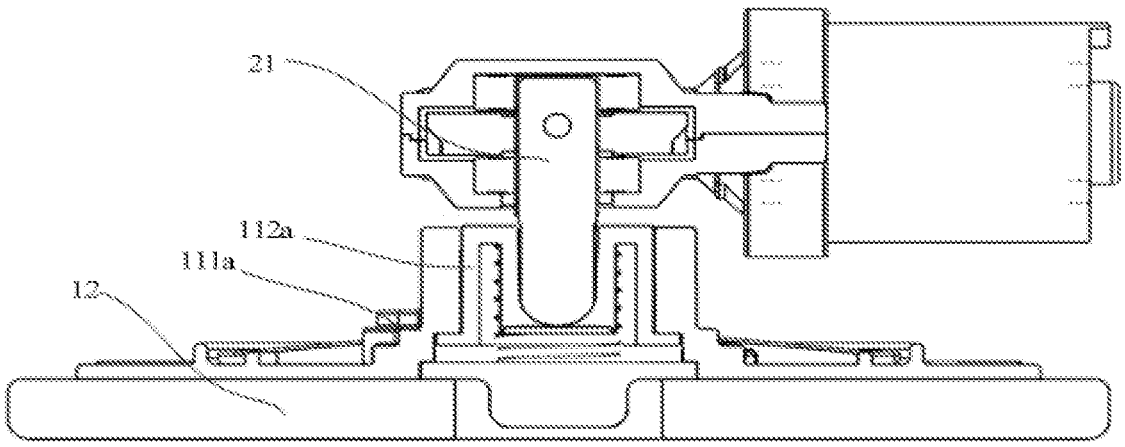
FIG. 5 is another cross-sectional view of the mopping module shown in FIG. 1.
Figure 6:
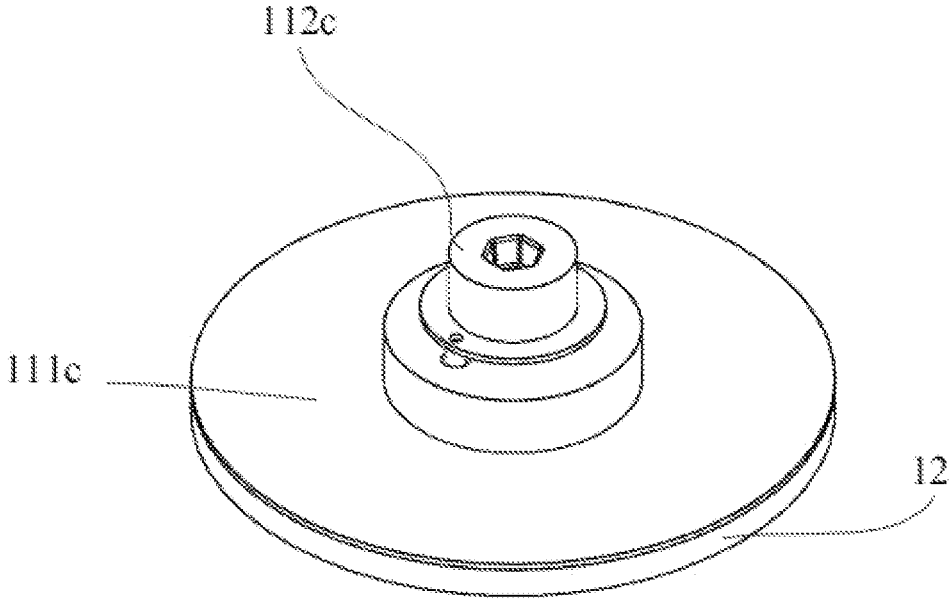
FIG. 6 is a perspective schematic view of the mopping module provided by another embodiment of the present application.
Figure 7:
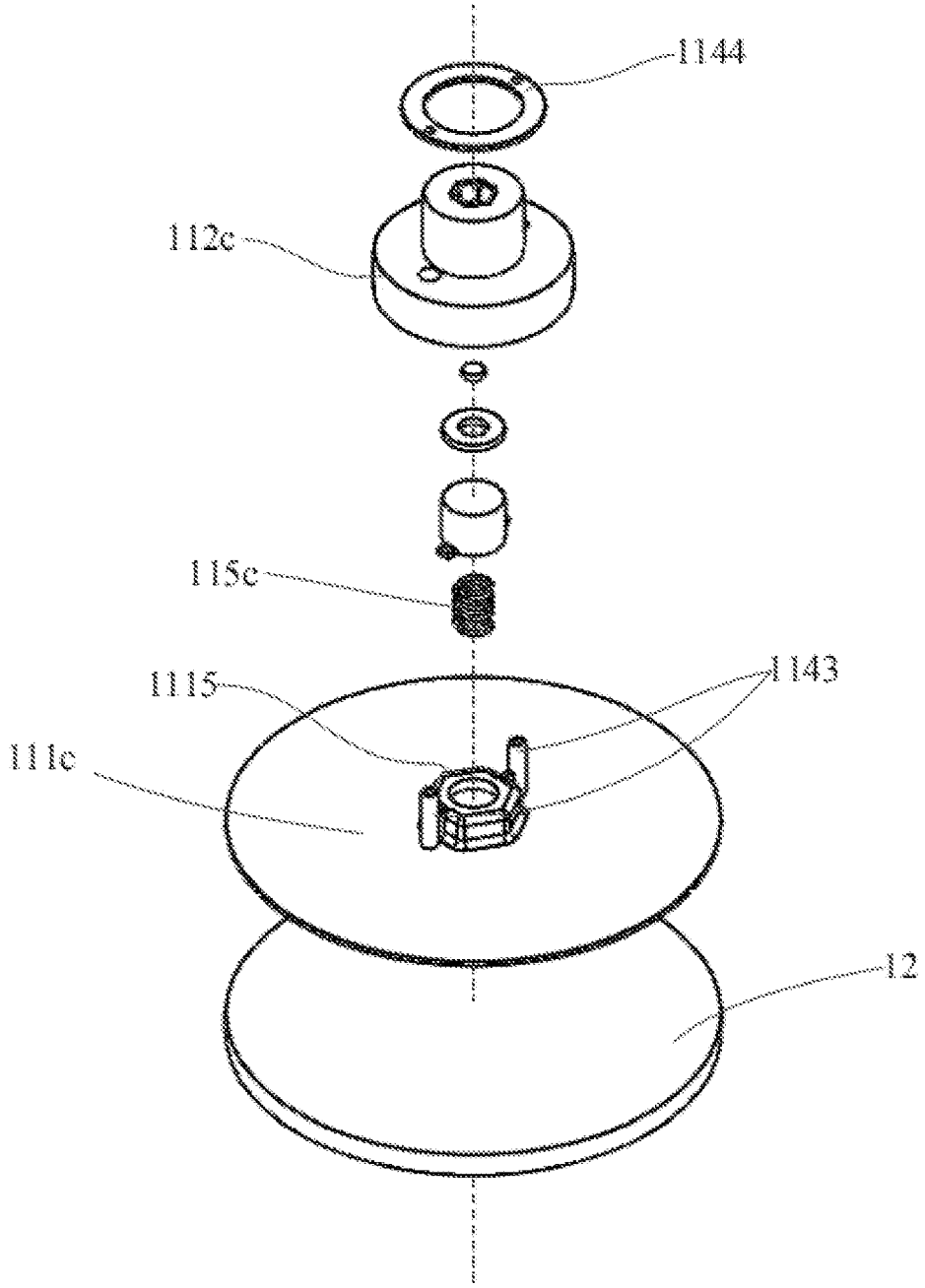
FIG. 7 is an exploded view of the mopping module of FIG. 6.
Figure 8:
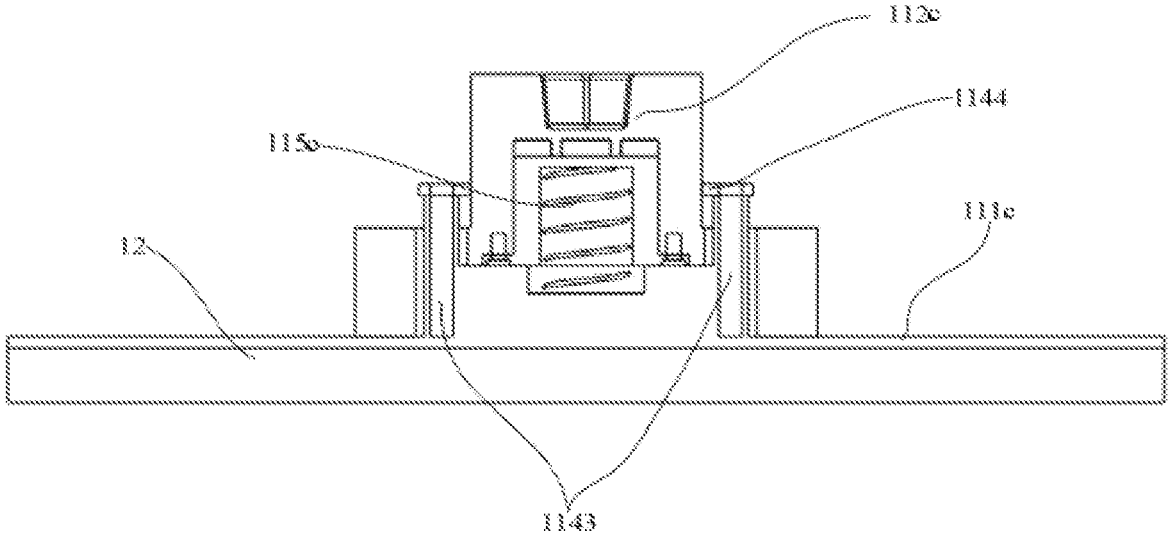
FIG. 8 is a cross-sectional view of the mopping module of FIG. 6.
Figure 9:
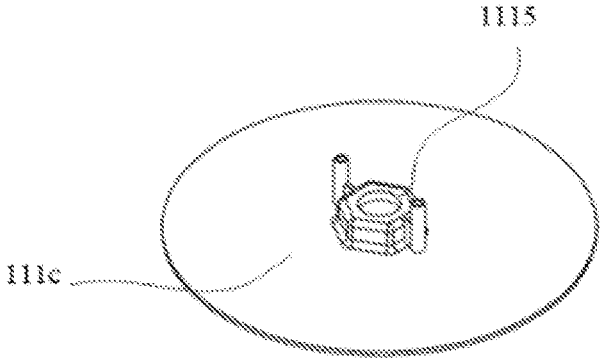
FIG. 9 is a perspective schematic view of the cleaning turntable of the mopping module shown in FIG. 6.

In an optional embodiment, as shown in FIGS. 3 and 5, the turntable structure 11*a* further includes a limiting structure. The limiting structure is configured to limit a sliding distance of the cleaning turntable 111*a* relative to the adjusting component 112*a* along the target direction, thereby the cleaning turntable 111*a* slides relative to the adjusting component 112*a* within a distance range limited by the limiting structure. When the target direction is a vertical direction, under the limitation of the limiting structure, the cleaning turntable can slide up and down relative to the adjusting component within a certain sliding distance.

According to the embodiment of the present application, because the technical solution of using the limiting structure in combination with the cleaning turntable 111*a* with telescoping function and the adjusting component 112*a* is adopted, it can prevent that the robot is unable to walk stably due to excessive extension or contraction of the turntable mechanism during using, or prevent that the cleaning piece 12 cannot fit the floor well due to too small extension or contraction of the turntable mechanism during using and affect the cleaning effect. There are many specific connections between the cleaning turntable 111*a* and the adjusting component 112*a*, and two of which: example 1 and example 2 are given as below.

Example 1: as shown in FIG. 3, the cleaning turntable 111*a* includes a first accommodating cavity, the adjusting component 112*a* is accommodated in the first accommodating cavity, and a outer surface of the adjusting component 112*a* is slidably connected with an inner wall of the first accommodating cavity along the target direction, and the outer surface of the adjusting component 112*a* includes a first limiting surface. The inner wall of the first accommodating cavity includes a second limiting surface. The first limiting surface and the second limiting surface are limited by each other to limit a relative rotation between the adjusting component and the cleaning turntable. Specifically, the first limiting surface and the second limiting surface may be non-cylindrical surfaces, for example, the first limiting surface and the second limiting surface are flat surfaces extending outward along a rotating center of the cleaning turntable. When the adjusting component rotates, the first limiting surface of the adjusting component abuts against the second limiting surface of the first accommodating cavity, so that the relative rotation between the adjusting component and the cleaning turntable is restricted. For example, in the cleaning turntable of the embodiment shown in FIG. 3, after the adjusting component 112*a* is sleeved in the first turntable housing 1111 of the cleaning turntable 111*a*, the adjusting component 112*a* is accommodated in the first accommodating cavity of the cleaning turntable 111*a*. The cleaning turntable 111*a* can slide relative to the adjusting component 112*a* along the target direction. On a plane perpendicular to the target direction, the cleaning turntable 111*a* and the adjusting component 112*a* are fixedly connected, and when the adjusting component 112*a* is driven to rotate by the driving shaft 21, the part of the non-cylindrical surface (i.e., the first limiting surface) of the outer surface of the adjusting component 112*a* and the part of the non-cylindrical surface (i.e., the second limiting surface) of the inner wall of the first accommodating cavity of the cleaning turntable 111*a* abut against each other, thereby limiting the relative rotation between the cleaning turntable 111*a* and the adjusting component 112*a*.

Example 2: the embodiment of the present application also provides another implementation manner of the cleaning turntable. As shown in FIGS. 6 to 9, one side of the cleaning turntable 111*c* far away from the cleaning piece 12 includes a connection portion 1115, and the adjusting component 112*c* includes a second accommodating cavity. The connection portion 1115 is accommodated in the second accommodating cavity. An outer surface of the connection portion 1115 is slidably connected with an inner wall of the second accommodating cavity along the target direction; and the outer surface of the connection portion 1115 includes a third limiting surface. The inner wall of the second accommodating cavity includes a fourth limiting surface. The third limiting surface and the fourth limiting surface are limited by each other to limit the relative rotation between the adjusting component 112*c* and the cleaning turntable 111*c*. Specifically, the third limiting surface and the fourth limiting surface may both be non-cylindrical surfaces, for example, the third limiting surface and the fourth limiting surface are partial surfaces of a cylinder surface with a cross section of regular polygon. When the adjusting component rotates, the third limiting surface of the adjusting component 112*c* and the fourth limiting surface of the second accommodating cavity abut against each other, thereby restricting the relative rotation between the adjusting component 112*c* and the cleaning turntable 111*c*.

The examples shown in FIGS. 6 to 9 are alternatives to the example of the connection of the cleaning turntable and the adjusting component shown in FIG. 3. In the examples shown in FIGS. 6 to 9, a cross section of the connection portion 1115 of the cleaning turntable 111*c* and a cross-section of the second accommodating cavity of the adjusting component 112*c* are both regular polygons, so that after the connection portion 1115 is sleeved in the second accommodating cavity, when the adjusting component 112*c* rotates, a part of surfaces of the connection portion 1115 abuts against a part of the inner wall of the second accommodating cavity, thereby limiting the relative rotation between the adjusting component 112*c* and the cleaning turntable 111*c* around the rotating shaft of the cleaning turntable 111*c*.

There are many ways to achieve the limiting structure. For example, based on the above-mentioned example 1 or example 2, there are many ways to achieve the limiting structure.

In an embodiment of the present application, as shown in FIGS. 3 and 5, the limiting structure includes a limiting block 1141*a* and a limiting groove 1142*a*. The limiting block 1141*a* is protruded from the adjusting component 112*a*, and the limiting groove 1142*a* is provided in surrounding walls of the second accommodating cavity, and the limiting block 1141*a* is accommodated in the limiting groove 1142*a*, and groove walls of the limiting groove 1142*a* is configured to limit a moving distance of the limiting block 1141*a* along the target direction. In the embodiment of the present application, the limiting block 1141*a* and the limiting groove 1142*a* are provided between the adjusting component 112*a* and the cleaning turntable 111*a*.

For example, in the embodiment of the present application, as shown in FIGS. 3 and 5, the limiting block 1141*a* is provided on the outer surface of the adjusting component 112*a*, and the limiting groove 1142*a* is provided on the inner wall of the second accommodating cavity of the cleaning turntable 111*a*. When a direction of the rotating shaft of the cleaning turntable 111*a* is vertical, the force applied to the cleaning turntable 111*a* by the floor is greater than the sum of the force applied to the cleaning turntable 111*a* by the elastic element 115*a* and the gravity of the cleaning turntable 111*a*, the cleaning turntable 111*a* slides upwards relative to the adjusting component 112*a* until the limiting block 1141*a* abuts against a lower groove wall of the limiting groove 1142*a*, the cleaning turntable 111*a* stops sliding upwards relative to the adjusting component 112*a*, and such state is shown in FIG. 3. When the force applied to the cleaning turntable 111*a* by the floor is less than the sum of the force applied to the cleaning turntable 111*a* by the elastic element 115*a* and the gravity of the cleaning turntable 111*a*, the cleaning turntable 111*a* slides downwards relative to the adjusting component 112*a* until the limiting block 1141*a* abuts against an upper groove wall of the limiting groove 1142*a*, the cleaning turntable 111*a* stops sliding downwards relative to the adjusting component 112*a*, and such state is shown in FIG. 5. It can be understood that, in the embodiment of the present invention, as shown in FIGS. 3 and 5, the cleaning turntable 111*a* includes the first turntable housing 1111 and the limiting plate 1112. The limiting groove 1142*a* is formed by a part of an inner surface of the first turntable housing 1111 and a part of an upper surface of the limiting plate 1112. Thus, the limiting block 1141*a* abutting against the lower groove wall of the limiting groove 1142*a* is that the limiting block 1141*a* abuts against the limiting plate 1112, and the limiting block 1141*a* abutting against the upper groove wall of the limiting groove 1142*a* is that the limiting block 1141*a* abuts against the first turntable housing 1111.

Optionally, the limiting groove 1142*a* may be provided on the outer surface of the adjusting component 112*a*, and the limiting block 1141*a* may be provided on the inner wall of the second accommodating cavity of the cleaning turntable 111*a*. It can be understood that the limiting structure may also be implemented in other specific manners, for example, in the specific implementation manner of the above example 1, in the first accommodating cavity of the cleaning turntable, an open end of the first accommodating cavity is provided with a stopper extending toward inside of the first accommodating cavity, and the stopper, wall surfaces of the first accommodating cavity and a bottom of the first accommodating cavity form a limiting structure, and the adjusting component is limited by the limiting structure, thereby the moving distance of the cleaning turntable relative to the adjusting component along the target direction is a distance between the stopper and the bottom of the first accommodating cavity.

In FIGS. 6 to 9, the limiting structure includes a surface of the cleaning turntable 111*c*, a sliding rod 1143 and a limiting fixing block 1144. After the sliding rod 1143 is sleeved in a through hole on the adjusting component 112*c*, the limit fixing block 1144 is fixedly connected to an end of the sliding rod 1143, thereby the adjusting component 112*c* can slide along the sliding rod 1143 between the limit fixing block 1144 and the surface of the cleaning turntable 111*c*. In other words, the sliding distance of the cleaning turntable 111*c* relative to the adjusting component 112*c* is a distance between the limit fixing block 1144 and the surface of the cleaning turntable 111*c*. It can be understood that, in the examples shown in FIGS. 6 to 9, the limiting structure can also be a limiting block and a limiting groove. At this time, the limiting block and the limiting groove are located between the connection portion of the cleaning turntable and a groove of the adjusting component. For example, the limiting groove is provided on an outer surface of the connection portion. The limiting block is provided on an inner wall surface of the groove of the adjusting component, and the limiting block is located in and movable in the limiting groove. It can be understood that the pressure unit 115*a* of the embodiment of the present application can be implemented in many ways, two of which are listed below as examples.

Example 1: as shown in FIGS. 2 to 5, the pressure unit 115*a* can be an elastic element 115*a*, and the elastic element 115*a* may be, for example, a spring, a bellows, or a leaf spring, etc. In the implementation manner shown in FIGS. 6 to 9, the pressure unit 115*a* is an elastic element 115*c*, and the elastic element 115*c* is located between the cleaning turntable 111*c* and the adjusting component 112*c*. When the pressure unit is an elastic element, the direction of the force applied to the cleaning turntable by the pressure unit is parallel to the target direction. For example, as shown in FIG. 3, the elastic element 115*a* is a coil spring, one end of the coil spring abuts against the adjusting component, and the other end of the coil spring abuts against the cleaning turntable. In order to increase an amount of the extension and contraction of the coil spring, an annular cavity is provided on the adjusting component, and the coil spring is sleeved in the annular cavity. When the pressure unit 115*a* is the elastic element 115*a*, since the elastic element 115*a* has a shock-absorption effect, it can also make the sliding upward of the cleaning turntable 111*a* relative to the adjusting component 112*a* more smoothly. Two ends of the spring elastically abut against the cleaning turntable and the adjusting component respectively.

Figure 10:
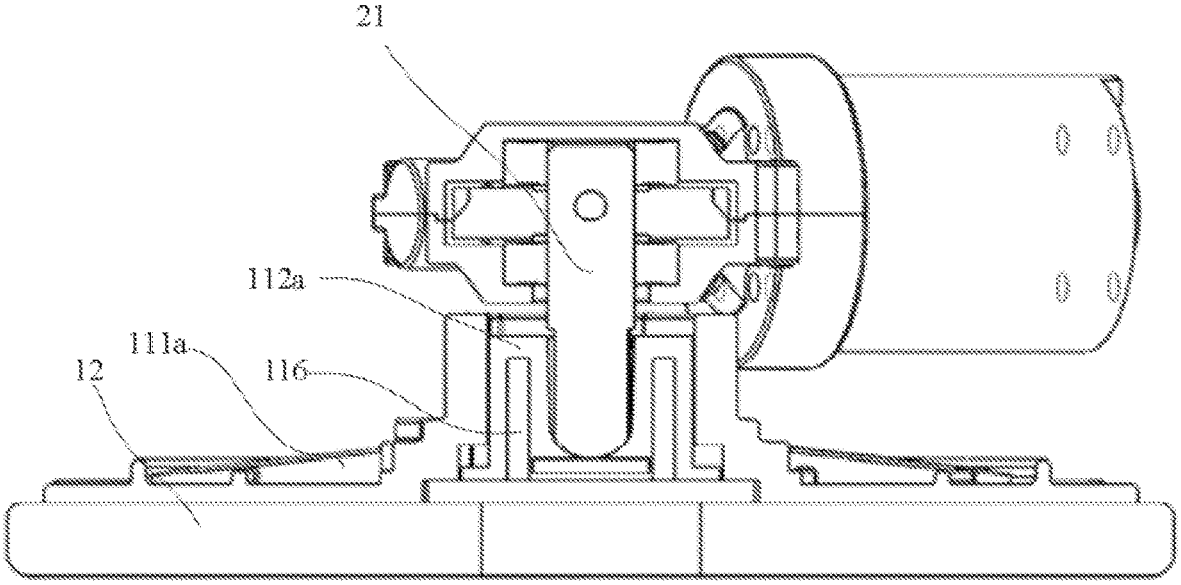
FIG. 10 is a cross-sectional view of the mopping module and the driving mechanism provided by another embodiment of the present application.
Figure 11:
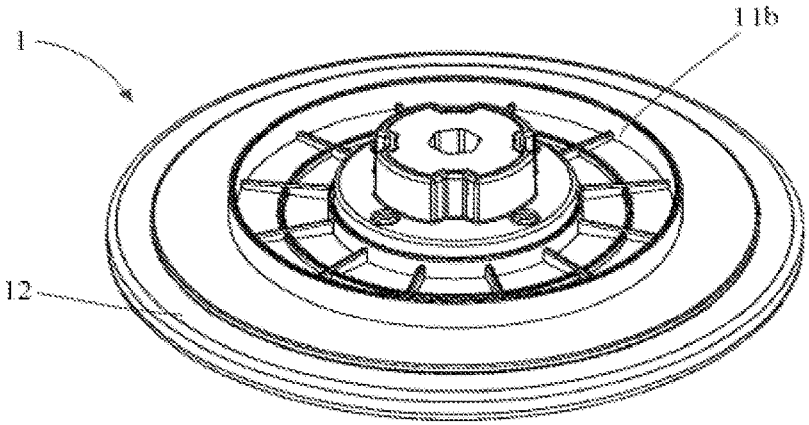
FIG. 11 is a perspective schematic view of the mopping module provided by another embodiment of the present application.
Figure 12:
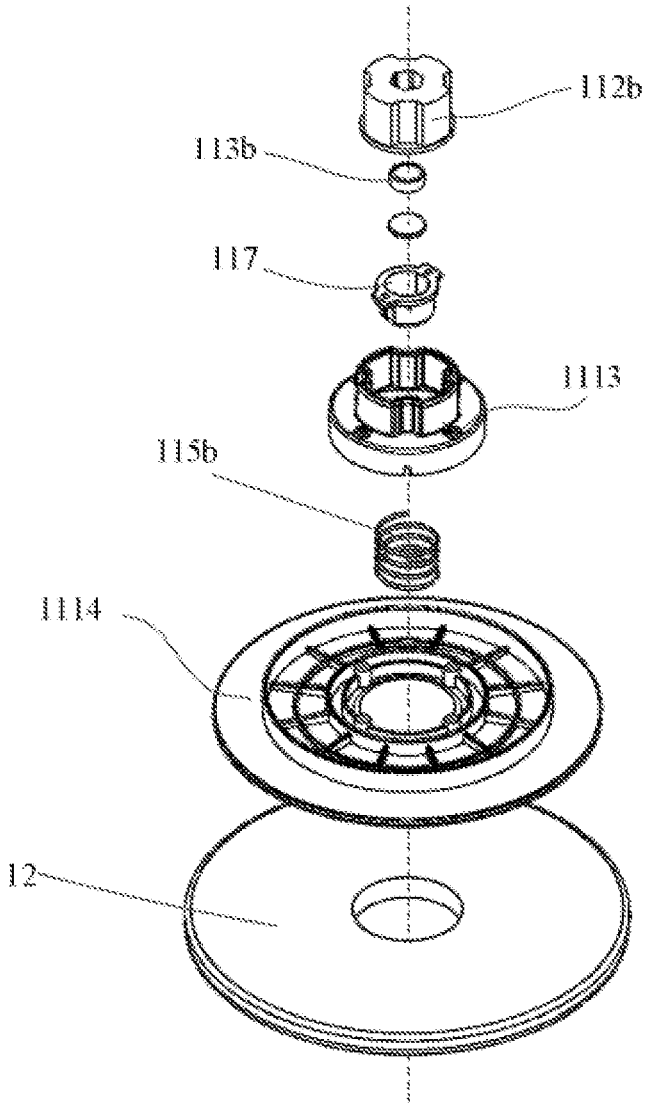
FIG. 12 is an exploded view of the mopping module shown in FIG. 11.

Example 2: as shown in FIG. 10, the pressure unit 115*a* may also be a gravity element 116, and a weight of the gravity element 116 is greater than a preset weight. At this time, the direction of the force applied to the cleaning turntable by the pressure unit 115*a* is kept vertically downward. The material of the gravity element 116 may be metal, ceramic, plastic, etc., which is not specifically limited in the embodiments of the present application. For example, the gravity element 116 is a cylindrical metal block, which is accommodated in the annular cavity provided on the adjusting component. The gravity block abuts against the cleaning turntable under the action of gravity and applies a vertical downward force to the cleaning turntable.

To sum up, in the turntable structure 11*a* provided by the present application, one side of the cleaning turntable 111*a* is connected with the cleaning piece 12, and on the other side of the cleaning turntable 111*a*, the adjusting component 112*a* is slidably connected with the cleaning turntable 111*a* along the target direction, thereby the cleaning turntable 111*a* can slide relative to the adjusting component 112*a*. When the target direction is perpendicular to the horizontal plane, the pressure unit 115*a* is configured to apply a vertical downward force to the cleaning turntable 111*a*, and the cleaning turntable 111*a* is slidable relative to the adjusting component 112*a* along the target direction, so that the cleaning piece 12 configured to clean the floor can keep fitting the floor, thereby improving the cleaning effect to the floor.

Second Embodiment

This application also proposes a mopping device. As shown in FIGS. 1 to 3, the mopping device includes: a cleaning turntable 111*a*, an adjusting component 112*a*, a driving mechanism 2 and a pressure unit 115*a*; and the cleaning turntable 111*a*, the adjusting component 112*a*, the driving mechanism 2 and the pressure unit 115*a* are assembled together. The adjusting component 112*a* is relatively slidably connected with the cleaning turntable 111*a* in a direction parallel to an axis of the cleaning turntable 111*a*, and the cleaning turntable 111*a* is located at a first position when sliding to the furthest distance relative to the adjusting component 112*a*. The cleaning turntable 111*a* is located at a second position when sliding to the closest distance relative to the adjusting component 112*a*. The driving mechanism 2 is connected with and drives the adjusting component 112*a* to rotate for driving a rotation of the cleaning turntable. The pressure unit 115*a* is provided between the cleaning turntable 111*a* and the adjusting component 112*a*, and the pressure unit 115*a* pushes against the cleaning turntable 111*a*. The cleaning turntable 111*a* is located at the first position relative to the adjusting component 112*a* when the cleaning turntable 111*a* is not subjected to an external force; the cleaning turntable 111*a* is located at the second position relatively to the adjusting component 112*a* when the cleaning turntable 111*a* is subjected to an external force much greater than the pressure of the pressure unit 115*a*. and when the external force applied to the cleaning turntable 111*a* is less than the pressure of the pressure unit 115*a*, the pressure unit 115*a* drives the cleaning turntable 111*a* to move from the second position to the first position relative to the adjusting component 112*a* until the cleaning turntable 111*a* is subjected to balanced forces, and the cleaning turntable 111*a* is located at a third position relative to the adjusting component 112*a*. The third position is located between the first position and the second position.

In an embodiment of the present application, the pressure unit 115*a* of the embodiment of the present application is an elastic element 115*a*, and the elastic element 115*a* elastically abuts against the cleaning turntable 111*a* and the adjusting component 112*a*, respectively. The elastic element 115*a* is specifically a spring. Both ends of the spring elastically abut against the cleaning turntable 111*a* and the adjusting component 112*a* respectively.

In an embodiment of the present application, as shown in FIGS. 1 to 5, the mopping device further includes a limiting structure, which is configured to limit a sliding distance of the cleaning turntable 111*a* relative to the adjusting component 112*a* along the target direction. The limiting structure includes a limiting block 1141*a* and a limiting groove 1142*a*, the limiting block 1141*a* is accommodated in the limiting groove 1142*a*, and groove walls of the limiting groove 1142*a* is configured to limit the moving distance of the limiting block 1141*a* along the target direction. The limiting block 1141*a* and the limiting groove 1142*a* are provided between the adjusting component 112*a* and the cleaning turntable 111*a*, or the limiting block 1141*a* is provided on the adjusting component 112*a*, and the limiting groove 1142*a* is provided on the cleaning turntable 111*a*, or the limiting block 1141*a* is provided on the cleaning turntable 111*a*, and the limiting groove 1142*a* is provided on the adjusting component 112*a*. The limiting block 1141*a* is located at the first position, and a groove surface of the limiting groove 1142*a* facing the limiting block 1141*a* is located at the second position.

In an embodiment of the present application, the driving mechanism 2 includes a driving shaft 21. The driving shaft 21 is configured to rotate the adjusting component 112*a* and the adjusting component 112*a* swings relative to the driving shaft 21.

In an embodiment of the present application, the driving shaft 21 is connected with the adjusting component 112*a* by a shaft sleeve 61 and a shaft end 62. The shaft sleeve 61 is provided with a groove, and the shaft end 62 is sleeved in the groove of the shaft sleeve 61. An end of the shaft end 62 is slidably connected with a bottom of the shaft sleeve 61, and a sliding direction of the end of the shaft end 62 relative to the bottom of the shaft sleeve 61 is the same as a swing direction of the adjusting component 112*a* relative to the driving shaft 21. There is a gap between a inner surface of the shaft sleeve 61 and an outer surface of the shaft end 62. The gap changes from large to small from an opening of the groove of the shaft sleeve 61 to the bottom of the shaft sleeve 61, so that the adjusting component is able to swing relative to the driving shaft 21. The inner surface of the shaft sleeve is provided with a fifth limiting surface, the outer surface of the shaft end 62 is provided with a sixth limiting surface corresponding to the fifth limiting surface, and the fifth limiting surface and the sixth limiting surface are limited by each other to limit a relative rotation of the shaft sleeve 61 and the shaft end 62. The shaft sleeve 61 is provided on the adjusting component 112*a*, and the shaft end 62 is provided on the driving shaft 21; or the shaft sleeve 61 is provided on the driving shaft 21 and the shaft end 62 is provided on the adjusting component 112*a*.

In an embodiment of the present application, as shown in FIGS. 2 and 3, a magnetic unit 113*a* is provided at the bottom of the shaft sleeve 61, and the magnetic unit 113*a* is configured to magnetically connect with the shaft end 62. Optionally, the magnetic unit 113*a* can be a magnet.

Figure 17:
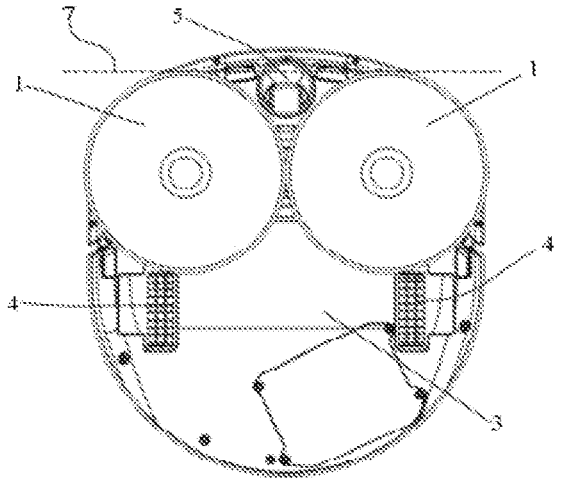
FIG. 17 is a bottom view of a robot provided by another embodiment of the present application.

In an embodiment of the present application, as shown in FIG. 17, a bottom of the mopping device is provided with two driving wheels 4 and one universal wheel 5. The two driving wheels 4 and the universal wheel 5 are configured to support the mopping device on the floor. The cleaning turntable 111*a* is provided between the two driving wheels 4 and the universal wheel 5. The universal wheel 5 is provided before the cleaning turntable 111*a* along an advance direction of the mopping device.

In an embodiment of the present application, a number of cleaning turntables 111*a* is two. The universal wheel 5 is located between the two cleaning turntables 111*a*, and intersects with a target tangent line. The target tangent is perpendicular to the advance direction of the mopping device and is the foremost tangent line among tangent lines tangent to at least one of the two cleaning turntables along the advance direction of the mopping device. In other words, in a direction perpendicular to the advance direction of the mopping device, there may be one or more tangent lines tangent to at least one of the two mopping modules 1, and the foremost tangent line among these tangent lines along the advance direction of the mopping device is the target tangent line 7. For example, in the mopping device shown in FIG. 17, the cleaning piece 12 of the mopping module 1 is a circular mop, two same mopping modules 1 are provided on the mopping device. The target tangent line 7 is perpendicular to the advance direction of the mopping device and is tangent to the two mopping modules 1, and the universal wheel 5 intersects with the target tangent line 7.

In other examples, the cleaning piece of the mopping module 1 may be a mop of other shapes, such as polygons, irregular figures, etc. During the rotation of the mopping module 1, there may be many tangent lines perpendicular to the advance direction of the robot and tangent to the mopping module 1. The foremost tangent line among those tangent lines along the advance direction of the robot is the target tangent line.

In such way, when the robot is working, for the universal wheel 5 is located before the two mopping modules 1 along the advance direction of the robot, when encountering an obstacle, the universal wheel 5 contacts the obstacle prior to the mopping module 1, the universal wheel 5 facilitates the robot to cross the obstacle. In addition, the universal wheel 5 is located between the two mopping modules 1, and intersects with the target tangent line 7, so that the universal wheel 5 can be located more closely to the mopping module 1. A head edge of the robot can be closer to the mopping module 1 because the universal wheel 5 is closer to the mopping module 1, thereby reducing a distance between the head edge of the robot and the mopping module 1. In this way, when head of the robot collides with an obstacle, a distance between the head edge of the robot and the mopping module 1 is a hard-to-clean area which cannot be cleaned by the mopping module 1. However, the mopping module 1 of the robot of the embodiment of the present invention is closer to the head edge of the robot, that is, the mopping module 1 is closer to the obstacle, thereby the mopping module 1 can clean more area during working.

In an embodiment of the present application, the mopping device further includes a cleaning piece 12 which is provided on one side of the cleaning turntable 111 facing away from the driving mechanism 2. The cleaning piece 12 is provided to clean areas to be cleaned. Optionally, the cleaning piece 12 can be a mop or a bristle.

Third Embodiment

In order to provide a more intuitive understanding of the turntable structure provided by the embodiment of the present application, one specific example of the turntable structure 11*b* provided by the embodiment of the present application will be described in detail as shown in FIGS. 11 to 16 as below:

as the example shown in FIGS. 11 to 16, a turntable structure 11*b* provided by the embodiment of the present application includes a cleaning turntable 111*b*, an adjusting component 112*b* and a spring 115*b* which is also named pressure unit 115*b*. The cleaning turntable 111*b* includes a second turntable housing 1113 and a turntable bottom plate 1114, and the turntable bottom plate 1114 and a bottom of the second turntable housing 1113 are fixedly connected by screws. One side of the turntable bottom plate 1114 far away from the second turntable housing 1113 is connected with the cleaning piece 12. The cleaning piece is a mop, which is configured to clean the floor. The mop and the turntable bottom plate 1114 are sticked through velcros provided between the mop and the turntable bottom plate 1114. The adjusting component 112*b* is accommodated in a first accommodating cavity formed by the second turntable housing 1113 and the turntable bottom plate 1114. During the installation process, the adjusting component 112*b* is sleeved in the second turntable housing 1113 from the bottom of the second turntable housing 1113, and then screws are used to fix the second turntable housing 1113 and the turntable bottom plate 1114 from an extension part of the second turntable housing 1113.

Figure 16:
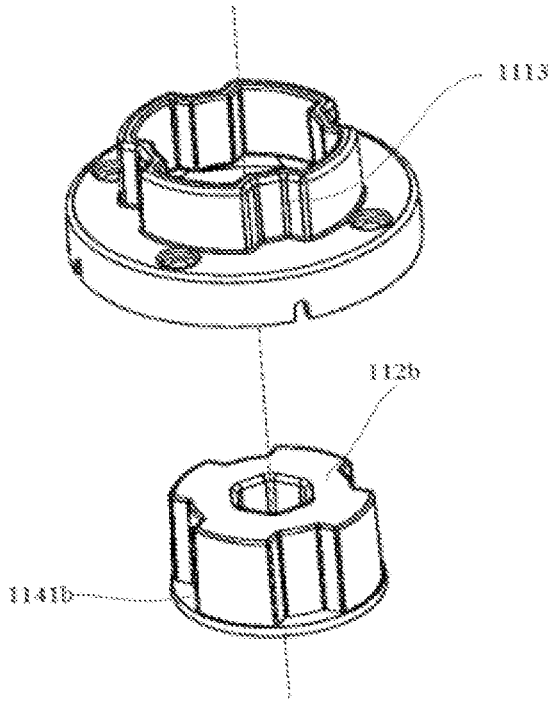
FIG. 16 is a perspective schematic view of the adjusting component and a second turntable housing shown in FIG. 11.

The adjusting component 112*b* is slidable relative to the second turntable housing 1113 along a direction of a rotating shaft of the cleaning turntable 111*b*. Specifically, an outer surface of the adjusting component 112*b* is located in the inner surface of the second turntable housing 1113 and the two can be abutted against each other. Along a direction parallel to the rotating shaft of the cleaning turntable 111*b*, the outer surface of the adjusting component 112*b* is slidable relative to the inner surface of the second turntable housing 1113. In a direction perpendicular to the rotating shaft of the cleaning turntable 111*b*, the adjusting component 112*b* is limited to move by the second turntable housing 1113. As shown in FIG. 16, a first limiting surface is provided on the outer surface of the adjusting component 112*b*, and a second limiting surface is provided on the inner surface of the second turntable housing 1113. The first limiting surface and the second limiting surface are both non-cylindrical surfaces, thereby the first and second limiting surfaces limit a relative rotation between the adjusting component 112*b* and the second turntable housing 1113, that is, the first and second limiting surfaces limit a relative rotation between the adjusting component 112*b* and the cleaning turntable 111*b*. In this way, when a driving mechanism of a robot drives the adjusting component 112*b* to rotate, the first limiting surface of the adjusting component 112*b* and the second limiting surface of the cleaning turntable 111*b* abut against each other, and the adjusting component 112*b* drives the cleaning turntable 111*b* to rotate.

Figure 13:
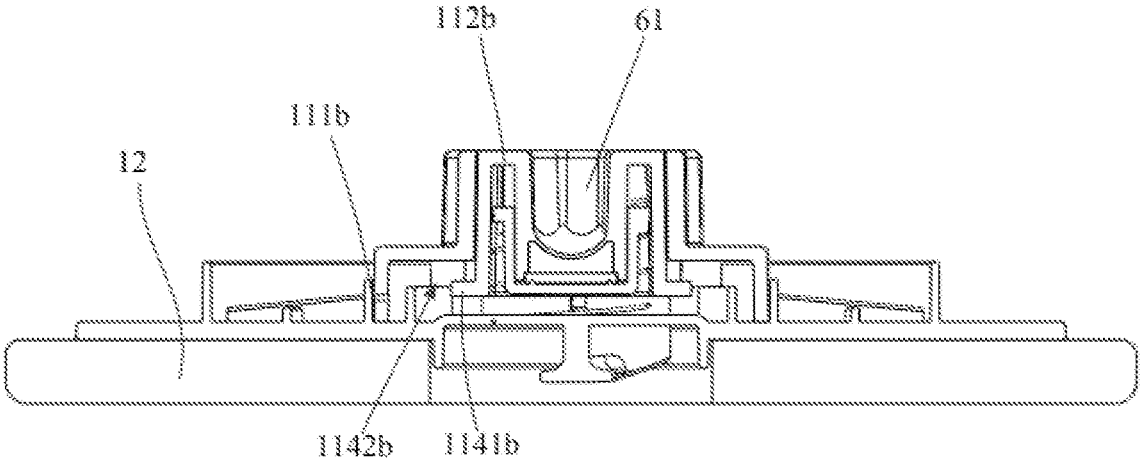
FIG. 13 is a cross-sectional view of the mopping module shown in FIG. 11.
Figure 14:
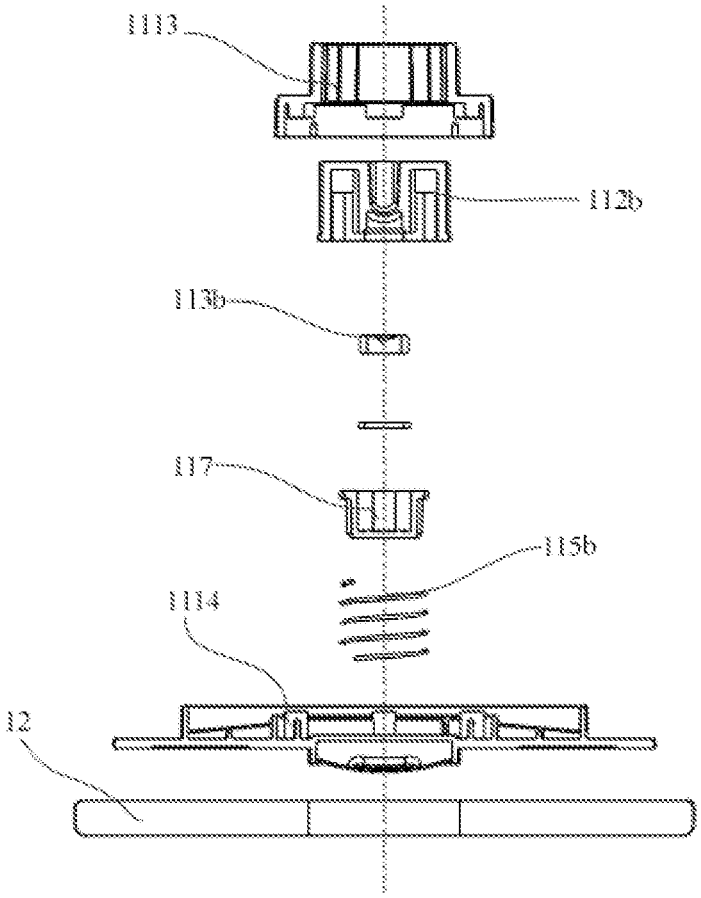
FIG. 14 is an exploded view of the mopping module shown in FIG. 11.
Figure 15:
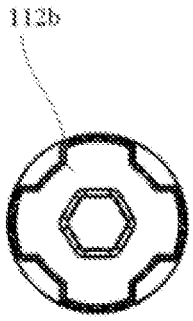
FIG. 15 is a top view of an adjusting component of the mopping module shown in FIG. 11.

As shown in FIG. 13, a limiting block 1141*b* is provided on the outer surface of the adjusting component 112*b*, and a limiting groove 1142*b* is defined in the cavity formed by the second turntable housing 1113 and the turntable bottom plate 1114. An upper groove wall of the limiting groove 1142*b* is located on the second turntable housing 1113, and a lower groove wall of the limiting groove 1142*b* is located on the turntable bottom plate 1114, so that after the limiting block 1141*b* is located in the limiting groove 1142*b*, so that after the limiting block 1141*b* is located in the limiting groove 1142*b*, the limiting groove 1142*b* moves between the upper groove wall and the lower groove walls of the limiting groove 1142*b*. Due to the fixed connection between the limiting groove 1142*b* and the adjusting component 112*b*, a sliding distance of the cleaning turntable 111*b* relative to the adjusting component 112*b* is a distance between the upper groove wall and the lower groove wall of the limiting groove 1142*b*. In such way, a set of limit structures including the limiting block 1141*b* and the limiting groove 1142*b* limits the sliding distance of the cleaning turntable 111*b* relative to the adjusting component 112*b* along the direction parallel to its rotating shaft.

In this embodiment, the spring 115*b* is provided between the cleaning turntable 111*b* and the adjusting component 112*b*. In this embodiment, one end of the spring 115*b* abuts against the adjusting component 112*b*, and the other end of the spring 115*b* abuts against the turntable bottom plate 1114, thereby the spring 115*b* applies force to the cleaning turntable 111*b* by applying an elastic force to the turntable bottom plate 1114. In this embodiment, position changes of the adjusting component 112*b* and the cleaning turntable 111*b* can cause a position change of the spring 115*b*. The elastic force of the spring 115*b* is parallel to the rotating shaft of the cleaning turntable 111*b*. An angle of the rotating shaft of the cleaning turntable 111*b* relative to a horizontal plane is same as an angle of the elastic force of the spring 115*b* relative to the horizontal plane. For example, when the rotating shaft of the cleaning turntable 111*b* is inclined to the floor, the elastic force of the spring 115*b* has an angle with the floor, when the rotating shaft of the cleaning turntable 111*b* is perpendicular to the horizontal plane, the elastic force of the spring 115*b* is also perpendicular to the horizontal plane, so that the spring 115*b* applies a vertical downward force to the cleaning turntable 111*b*.

In this example, a groove is provided at one end of the adjusting component 112*b* far away from the cleaning piece 12, and the groove is configured to let the driving shaft 21 of the driving mechanism 2 be sleeved therein, so that the driving shaft 21 transmits a torque to the adjusting component 112*b*. A magnet 113*b* is provided at the bottom of the groove of the adjusting component 112*b*. Specifically, the magnet 113*b* is sealed at the bottom of the adjusting component 112*b* by a magnet sealing ring, and a magnet fixing block 117 is used to sleeve in the bottom of the adjusting component 112*b* to fix the magnet 113*b* on the bottom of the adjusting component 112*b*, i.e., the bottom of the groove aforementioned.

To sum up, one side of the cleaning turntable 111*b* is connected with the cleaning piece 12, and on the other side of the cleaning turntable 111*b*, the adjusting component 112*b* is slidably connected with the cleaning turntable 111*b* along the target direction, so that the cleaning turntable 111*b* can slide relative to the adjusting component 112*b*. When the target direction is perpendicular to the horizontal plane, the spring 115*b* is configured to apply a vertical downward force to the cleaning turntable 111*b*, and the cleaning turntable 111*b* can slide relative to the adjusting component 112*b* along the target direction, the cleaning piece 12 configured to clean the floor thus can keep fit the floor, thereby improving the cleaning effect on the floor.

Fourth Embodiment

The present application also provides a robot. As shown in 17, the robot includes: a mopping module 1, a driving mechanism 2 and a robot body 3. The mopping module 1 is provided at a bottom of the robot body 3, and the mopping module 1 includes a turntable structure 11*a* and a cleaning piece 12.

The turntable structure can be any turntable structure in any one of the foregoing embodiments, and will not be repeated here. In this embodiment, the turntable structure 11*a* of the first embodiment as an example of the turntable structure for description.

In this embodiment, the cleaning piece 12 is configured to clean the floor. The cleaning piece 12 can be a mop, a bristle, or other specific cleaning pieces. It should be understood that the manners to install cleaning piece 12 to the turntable structure 11*a* are flexible, and are not limited herein. For example, magnet adsorption, gluing bonding, bolt connection, or Velcro sticking, etc. can be used to achieve the connection between the cleaning piece 12 and the turntable structure 11*a*.

The driving mechanism 2 is installed on the robot body 3. As shown in FIG. 3, the driving mechanism 2 is connected with the adjusting component 112*a*, and the driving mechanism 2 is configured as rotate the mopping module 1.

In the embodiment of the present application, because the turntable structure 11*a* with telescoping function is adopted, the technical problem of poor floor cleaning effect of the cleaning robot in the related art can be at least partially solved, the purpose of the cleaning piece 12 keeping closely fit the floor when the robot is working is achieved, thereby improving the cleaning effect of the robot.

As an optional embodiment, as shown in FIG. 3, the driving mechanism 2 includes a driving shaft 21. The driving shaft 21 is connected with one side of the adjusting component 112*a* far away from the cleaning piece 12, and the driving shaft 21 is configured to rotate the adjusting component 112*a*. In such way, the connection between the driving mechanism 2 and the adjusting component 112*a* and the driving mechanism 2 driving the mopping module 1 to rotate can be achieved through the driving shaft 21. In addition, the driving shaft 21 can also provide a force parallel to the rotating shaft of the driving shaft 21 to the adjusting component 112*a*. For example, in the example shown in FIG. 3, the driving shaft 21 provides a force to the adjusting component 112*a*. The force is opposite to the force applied to the adjusting component 112*a* by the elastic element 115*a*.

In the embodiment of the present application, the adjusting component 112*a* is also swingable relative to the driving shaft 21.

When the robot is working, because the adjusting component 112*a* is slidably connected with the cleaning turntable 111*a* along the target direction, the cleaning piece 12 provided on the cleaning component of the cleaning turntable 111*a* can move along the target direction. In addition, the adjusting component 112*a* can also swing relative to the driving shaft 21. Due to the cleaning turntable 111*a* is connected with the driving shaft 21 by the adjusting component 112*a*, the cleaning turntable 111*a* and the cleaning piece 12 provided on the cleaning turntable 111*a* can swing relative to the driving shaft 21. In such way, when the target direction is perpendicular to the horizontal plane, the cleaning piece 12 can move up and down, or swing relative to the driving shaft, so that the cleaning piece 12 can adapt to the uneven and inclined floor for cleaning, thereby improving the cleaning effect.

Optionally, as shown in FIG. 3, the driving shaft 21 is connected with the adjusting component 112*a* by a connection of a shaft sleeve 61 and a shaft end 62. The shaft end 62 is sleeved in a groove of the shaft sleeve 61. An end of the shaft end 62 is slidably connected with a bottom of the shaft sleeve 61, and a sliding direction of the end of the shaft end 62 relative to the bottom of the shaft sleeve 61 is same as a swing direction of the adjusting component 112*a* relative to the driving shaft 21. For example, an end surface of the end of the shaft end 62 is a hemispherical surface, and the bottom of the shaft sleeve 61 is a hemispherical surface. After the two hemispherical surfaces abut against each other, the shaft end 62 can slide relative to the shaft sleeve 61 along a trajectory of the hemispherical surface, thereby driving the adjusting component to swing relative to the driving shaft 21, and a trajectory of the swing is the trajectory on the hemispherical surface.

There is a gap between the inner surface of the sleeve 61 and the outer surface of the shaft end 62. The gap changes from large to small from an opening of the groove of the shaft sleeve 61 to the bottom of the shaft sleeve 61 so that the adjusting component 112*a* can swing relative to the driving shaft 21. After the shaft end 62 is sleeved in the shaft sleeve 61, the gap between the inner surface of the shaft sleeve 61 and the outer surface of the shaft sleeve 62 changes from large to small as advancing from an opening of the groove of the shaft sleeve to the bottom of the shaft sleeve, thereby in the relative swing of the shaft end 62 and the sleeve 61, a swing amplitude at the opening of the groove of the sleeve 61 is greater than a swing amplitude at the bottom of the sleeve 61. In such way, a relative swing amplitude between the shaft end 62 and the sleeve 61 can be set to be larger, so that a swing amplitude of the adjusting component 112*a* relative to the driving shaft 21 can be larger.

A limiting surface is provided on the inner surface of the sleeve 61, and a limiting surface is provided on the outer surface of the shaft end 62. The limiting surface on the inner surface of the sleeve 61 and the limiting surface on the outer surface of the shaft end 62 are limited by each other to limit a relative rotation between the sleeve 61 and the shaft end 62. For example, cross sections of the shaft end 62 and the shaft sleeve 61 have a same shape but different sizes. The cross sections of the shaft end 62 and the shaft sleeve 61 can be a regular polygon. After the shaft end 62 is sleeved in the shaft sleeve 61, when the shaft end 62 rotates, surfaces where the shaft end 62 and the shaft sleeve 61 fit together are the limiting surfaces of the shaft end 62 and the shaft sleeve 61, thereby limiting the relative rotation between the shaft sleeve 61 and the shaft end 62 to make the shaft end 62 transmit the torque to the shaft sleeve 61 and the driving shaft 21 drive the adjusting component 112*a* to rotate.

Figure 18:
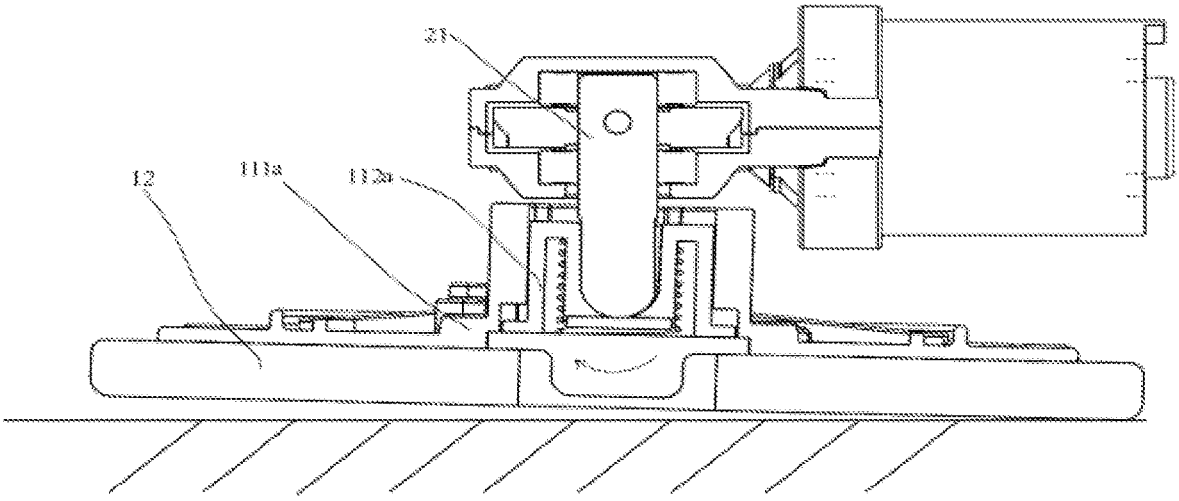
FIG. 18 is a cross-sectional view of part structure of a robot shown in FIG. 17.
Figure 19:
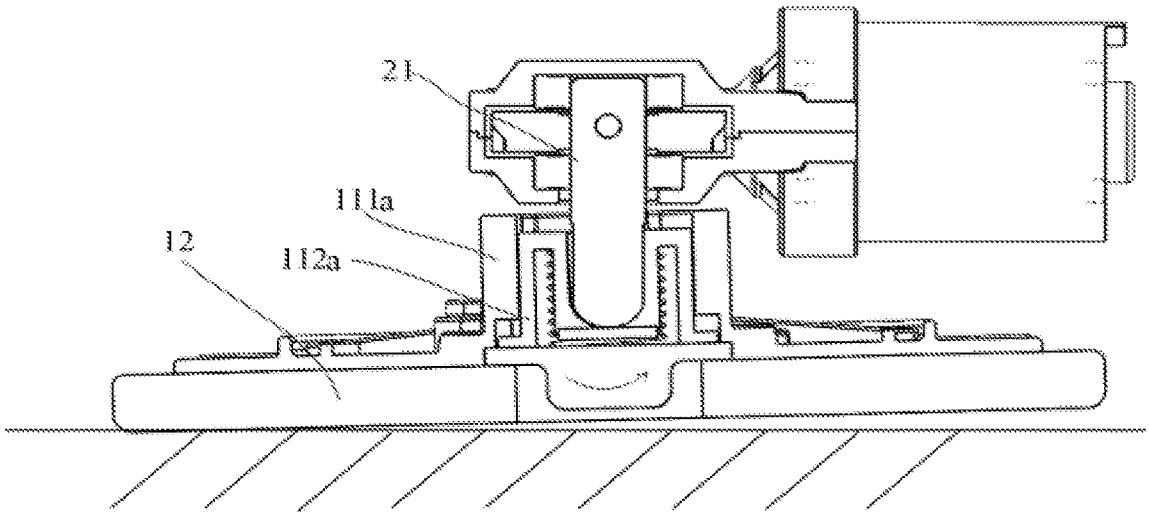
FIG. 19 is another cross-sectional view of the part structure of the robot shown in FIG. 17.

In an example, the shaft sleeve 61 is provided on the adjusting component 112*a*, and the shaft end 62 is provided on the driving shaft 21. For example, as shown in FIGS. 18 and 19, a groove structure is provided on one side of the adjusting component 112*a* far away from the cleaning piece 12, and the groove structure is the shaft sleeve 61 aforementioned. The shaft end 61 and the driving shaft 21 are fixedly connected or are formed in one. The shaft end 62 can be sleeved in the shaft sleeve 61.

In another example, the shaft sleeve is provided on the driving shaft 21, and the shaft end is provided on the adjusting component 112*a*. For example, a groove structure is provided on an end of the driving shaft 21 close to the mopping module, and the groove structure is a shaft sleeve. The shaft end is provided on a side of the adjusting component 112*a* close to the driving shaft 21.

In such way, the adjusting component 112*a* can swing around the driving shaft 21 through the gap between the shaft end 62 and the shaft sleeve 61 as above-mentioned, thereby driving the cleaning piece 12 connected to the cleaning turntable 112*a* to swing around relative to the driving shaft 21. For example, as shown in FIGS. 18 and 19, a shaft sleeve 61 is provided on the side of the adjusting component 112*a* far away from the cleaning piece 12, and the shaft end 62 and the driving shaft 21 are fixedly connected. The shaft end 62 is sleeved in the shaft sleeve 61, and there is a gap between an inner surface of the sleeve 61 and an outer surface of the shaft end 62. The gap changes from large to small from an opening of the groove of the shaft sleeve 61 to a bottom of the shaft sleeve 61, thereby the shaft end 62 can swing relative to the shaft sleeve 61, and accordingly, the cleaning turntable 111*a* can swing relative to the driving shaft 21. Taking the advance direction of the robot as the front, in FIG. 18, the cleaning turntable 111*a* swings forwards relative to the driving shaft 21. In FIG. 19, the cleaning turntable 111*a* swings backward relative to the driving shaft 21.

In some embodiments, when the axis of the driving shaft 21 is coincided with the rotating shaft of the cleaning turntable 111*a*, the cleaning piece 12 connected with the cleaning turntable 111*a* can move along the target direction and swing towards to a direction perpendicular to the target direction which is parallel to the rotating shaft of the cleaning turntable 111*a*, thereby the cleaning piece 12 can adapt to the up and down unevenness of the floor to extend or contract, and adapt to the inclination of the floor to swing. In such way, the cleaning piece 12 can fit the floor, thereby improving the cleaning effect of the cleaning piece 12 to the floor.

In an optional embodiment, as shown in FIGS. 2 and 3, a magnetic unit 113*a* (such as a magnet) is provided at the bottom of the shaft sleeve 61, and configured to magnetically connect with the shaft end 62, thereby there is a magnetic connection between the adjusting component 112*a* and the driving shaft 21. Because the mopping module 1 is connected with the robot body 3 through the adjusting component 112*a* and the driving shaft 21, the mopping module 1 is connected with the robot body 3 through the magnetic connection to facilitate the user to assemble and disassemble the mopping module 1 and the robot body 3, and also make the connection between the mopping module 1 and the robot body 3 stable. In addition, even after a long time use, magnetic force of the magnetic unit 113*a* is still be maintained, especially when the magnetic unit 113*a* is a magnet, the wear of the magnetic unit 113*a* will not be caused by the long-term use and the relative movement of the sleeve 61 and the shaft end 62.

There are many ways to set the magnetic unit 113*a*. For example, referring to the above detailed description of the turntable structure shown in FIGS. 11 and 12, or the turntable structure 11*a* shown in FIG. 3, the magnetic unit 113*a* (such as a magnet) is provided at the bottom of the adjusting component 112*a*, i.e., the bottom of the installed groove of the adjusting component 112*a*. The magnetic unit 113*a* can be embedded in the installed groove of the adjusting component 112*a*, or be sealed in the installed groove by other components.

In some embodiments of the present application, as shown in FIGS. 2 and 3, the entire driving mechanism includes: the driving shaft 21, a bearing 22, a worm gear 23, a turbine housing 24, a worm gear pin 25 and a worm motor 26. A worm of the worm motor 26 is extended into the turbine housing 24, and the driving shaft 21 is extended from the turbine housing 24. The bearing 22, the worm gear pin 25 and the turbine 23 are provided in the turbine housing 24. Specifically, the turbine 23 is provided between two bearings 22, the driving shaft 21 penetrates the two bearings 22 and the turbine 23, and clamps an inner ring of the bearings 22. The driving shaft 21 can rotate relative to the outer ring of the bearing 22. The driving shaft 21 is fixedly connected to the worm gear 23 through the worm gear pin 25.

When using the robot, the worm motor 26 drives the worm wheel 23, and the worm wheel 23 drives the driving shaft 21 to rotate. The driving shaft 21 drives the adjusting component 112*a*, and the adjusting component 112*a* transmits the rotational motion to the cleaning turntable 111*a* to drive the cleaning piece 12 to rotate. The driving shaft 21 and the adjusting component 112*a* achieve the swing in the horizontal direction through the gap between the shaft sleeve 61 and the shaft end 62, so that the cleaning piece 12 is adapted to the floor with different flatness. The cleaning turntable 111*a* can slide relative to the adjusting component 112*a* along a target direction parallel to the rotating shaft of the cleaning turntable 111*a*.

Optionally, as shown in FIG. 17, two driving wheels 4 and one universal wheel 5 are provided on the bottom of the robot. The two driving wheels 4 and the universal wheel 5 are provided to support the robot on the floor. The mopping module 1 is provided among the two driving wheels 4 and the universal wheel 5, and the universal wheel 5 is provided before the mopping module 1 along the advance direction of the robot. In the embodiment of the present application, the driving wheel 4 can obtain power from a power device of the robot body 3 to rotate, thereby driving the robot to move. In the advance direction of the robot, the universal wheel 5 is provided before the mopping module 1, so that the universal wheel 5 is able to the robot to turn in multiple directions.

In the embodiments of the present application, in the turntable structure 11*a* of the mopping module 1, the cleaning turntable 111*a* can slide relative to the adjusting component 112*a* along the target direction, so that pressure applied to the floor by the cleaning turntable 111*a* can be adjusted. By adjusting the pressure to the floor, it not only ensures the cleaning effect to the floor, but also prevents the rear wheel from slipping due to excessive pressure.

In the robot provided by the present application, the two driving wheels 4 at the back and the one universal wheel 5 at the front can form a three-point landing layout, therefore an overall posture of the robot is determined by the two driving wheels 4 and the one universal wheel 5, and the robot walks on the floor stably. In addition, in the robot provided by the embodiment of the present application, since the universal wheel 5 is provided before the mopping module 1 along the advance direction of the robot, capability of the robot crossing the obstacle can be enhanced.

It can be understood that the driving mode of the robot in the embodiment of the present application can be others rather than the above-mentioned mode of two driving wheels 4 with one universal wheel 5. For example, the driving mode of the robot is provided with two, four or more wheels at the bottom of the robot, or provided with a crawler mechanism at the bottom of the robot, or be other implementation modes, which are not specifically limited in the embodiment of the application.

It can be understood that a number of mopping modules in the present application can be one, two, or more, which is not specifically limited in the embodiments of the present application.

As an optional embodiment, a number of cleaning turntables 111*a* is two. At this time, the universal wheel 5 is located between the two mopping modules 1, and the universal wheel 5 intersects with a target tangent line 7. The target tangent 7 is perpendicular to the advance direction of the robot and is the foremost tangent line among tangent lines tangent to at least one of the two mopping modules along the advance direction of the robot. In other words, in the advance direction perpendicular to the robot, there may be one or more tangent lines tangent to at least one of the two mopping modules 1, and the foremost tangent line among those tangent lines along the advance direction of the robot is the target tangent line 7. For example, in the robot shown in FIG. 17, the cleaning piece 12 of the mopping module 1 is a circular mop, two same mopping modules 1 are provided on the mopping device. The target tangent line 7 is perpendicular to the advance direction of the robot and is tangent to the two mopping modules 1. The universal wheel 5 intersects with the target tangent line 7.

In other examples, the cleaning piece of the mopping module 1 may be a mop of other shapes, such as polygons, irregular figures, etc. During the rotation of the mopping module 1, there may be many tangent lines perpendicular to the advance direction of the robot and tangent to the mopping module 1. The foremost tangent among the tangent lines along the advance direction of the robot is the target tangent.

In such way, when the robot is working, for the universal wheel 5 is located before the two mopping modules 1 along the advance direction of the robot, when encountering an obstacle, the universal wheel 5 contacts the obstacle prior to the mopping module 1, the universal wheel 5 facilitates the robot to cross the obstacle. In addition, the universal wheel 5 is located between the two mopping modules 1, and intersects with the target tangent line 7, so that the universal wheel 5 can be located more closely to the mopping module 1. A head edge of the robot can be closer to the mopping module 1 because the universal wheel 5 is closer to the mopping module 1, thereby reducing a distance between the head edge of the robot and the mopping module 1. In this way, when head of the robot collides with an obstacle, a distance between the head edge of the robot and the mopping module 1 is a hard-to-clean area which cannot be cleaned by the mopping module 1. However, the mopping module 1 of the robot of the embodiment of the present invention is closer to the head edge of the robot, that is, the mopping module 1 is closer to the obstacle, thereby the mopping module 1 can clean more area during working.

The above descriptions are only optional embodiments of the application, and do not limit the scope of the patents of the present application. All the equivalent structural transformations made by the content of the specification and drawings of the present application under the creative concept of the present application, or directly/indirectly used in other related technical fields are all included in the protection scope of the patents of the present application.

What is claimed is:

1. A turntable structure, applied to a cleaning robot comprising a cleaning piece and a driving mechanism, the turntable structure comprising:

a cleaning turntable having a first side and a second side facing away from the first side, the first side being configured to be connected with the cleaning piece;

an adjusting component slidably connected with the cleaning turntable along a target direction and located on the second side of the cleaning turntable, the adjusting component having a side far away from the cleaning turntable which is configured to be connected with the driving mechanism to rotate the cleaning turntable, wherein the target direction is parallel to a rotating shaft of the cleaning turntable;

a pressure unit provided between the cleaning turntable and the adjusting component and capable of pressing against the cleaning turntable; and a first limiting structure configured to limit a sliding distance of the cleaning turntable relative to the adjusting component along the target direction, wherein the adjusting component is connected to a driving shaft of the driving mechanism by a shaft sleeve defining a groove and a shaft end received in the groove of the shaft sleeve; and a gap is defined between the shaft sleeve and the shaft end to make the adjusting component swingable relative to the driving shaft.

2. The turntable structure according to claim 1, wherein the shaft sleeve is provided on the adjusting component, and the shaft end is provided on the driving shaft; or the shaft sleeve is provided on the driving shaft, and the shaft end is provided on the adjusting component.

3. The turntable structure according to claim 1, wherein a cross section of the shaft end and a cross section of the shaft sleeve are identical in shape but different in size; and/or the cross section of the shaft end and the cross section of the shaft sleeve are both regular polygons.

4. The turntable structure according to claim 1, wherein a bottom of the shaft sleeve is slidably connected to an end of the shaft end, and a sliding direction of the end of the shaft end relative to the bottom of the shaft sleeve is identical to a swing direction of the adjusting component relative to the driving shaft.

5. The turntable structure according to claim 4, wherein an end face of the end of the shaft end and a bottom surface of the shaft sleeve are both hemispherical surfaces, and the shaft end is slidable along the bottom surface of the shaft sleeve, allowing the adjusting component to swing relative to the driving shaft.

6. The turntable structure according to claim 1, wherein a magnetic unit is provided at a bottom of the shaft sleeve to magnetically engage with the shaft end.

7. A mopping device comprising:

the turntable structure according to claim 1; and a driving mechanism configured to drive the adjusting component of the turntable structure to rotate the cleaning turntable of the turntable structure.

8. A robot comprising the mopping device according to claim 7.

* * * * *